US006019493A

United States Patent [19]

Kuo et al.

[11] Patent Number: 6,019,493

[45] Date of Patent: Feb. 1, 2000

[54] HIGH EFFICIENCY LIGHT FOR USE IN A TRAFFIC SIGNAL LIGHT, USING LED'S

[76] Inventors: Jeffrey Kuo; Kwo-Sou Huang; Chan-Chuan Tai, all of 11F., No. 375, Chung-Shan Rd., Sec. 1, Changhua City, Taiwan

[21] Appl. No.: 09/042,004

[22] Filed: Mar. 13, 1998

[51] Int. Cl.[7] ..... F21Q 3/00; G08G 1/07

[52] U.S. Cl. ..... 362/800; 362/267; 362/268; 362/331; 362/335; 116/63 R; 340/907

[58] Field of Search ..... 362/800, 458, 362/227, 236, 242–246, 268, 331–336, 267, 311, 326; 340/907; 116/63 R; 359/542, 534

*Primary Examiner*—Sandra O'Shea
*Assistant Examiner*—Ismael Negron
*Attorney, Agent, or Firm*—Rosenberg, Klein & Lee

[57] ABSTRACT

A high efficiency light which includes a conical lamp shade having a light reflecting inside wall, a circuit board mounted on inside the lamp shade and holding a set of LEDs, a hemispherical inner lens covered on the circuit board over the LEDs inside the lamp shade, the hemispherical inner lens having a center convex lens portion and a plurality of annular convex lens portions around the center convex lens portion, a flat intermediate lens covered on the front open side of the lamp shade, the flat intermediate lens having a center convex lens portion and a plurality of annular biconvex lens portions around the center convex lens portion, and a hollow rounded outer lens mounted on the front open side of the lamp shade over the flat intermediate lens and sealed by a packing ring, the hollow rounded outer lens having a center convex lens portion, a plurality of annular convex lens portions around the center convex lens portion, and a plurality of beehive-like convex lens portions around the annular convex lens portion.

2 Claims, 4 Drawing Sheets

HIGH EFFICIENCY LIGHT FOR USE IN A TRAFFIC SIGNAL LIGHT, USING LED'S

BACKGROUND OF THE INVENTION

The present invention relates to a high efficiency light, and more particularly to such a high efficiency light which uses LEDs to emit light, and different lenses to amplify the intensity of light from the LEDs.

A regular traffic signal light 7, as shown in FIG. 3, is generally comprised of a reflective lamp shade 71, an incandescent bulb 72 mounted inside the lamp shade 71, and a lens 73 covered on the front open side of the lamp shade 71. This structure of traffic signal light consumes much electric energy, and emits less intensity of light. The lamp shade 71 and the lens 73 cannot greatly amplify the intensity of light emitted from the incandescent bulb 72. FIG. 4 shows a LED type traffic signal light 8 according to the prior art. This structure of LED type traffic signal light 8 comprises a reflective lamp shade 81, a circuit board 82 mounted on the reflective lamp shade 81 and holding a set of LEDs (light emitting diodes) 83, and a hollow rounded lens 84 covered on the reflective lamp shade 81 over the LEDs 83. This structure of LED type traffic signal light 8 consumes less electric energy, however it is still not satisfactory in function. The drawbacks of this structure of LED type traffic signal light is outlined hereinafter.

1. The lens 84 does not effectively amplify the intensity of light passing through.
2. In order to obtain sufficient light, a big number of LEDs must be installed, thereby causing the cost of the traffic signal light unable to be reduced to the desired level.
3. In order to obtain a uniform intensity of light, the quality of used LEDs must be strictly examined.
4. Because the top side 85 of the circuit board 82 does not reflect light from the LEDs 83, downward emitting light rays from the LEDs 83 are wasted (see FIG. 5A).
5. Because light from the LEDs 83 is not well diffused, spots of light are seen from the outside corresponding to the LEDs 83.

SUMMARY OF THE INVENTION

The present invention has been accomplished to provide a high efficiency light which eliminates the aforesaid drawbacks. It is one object of the present invention to provide a high efficiency light which uses light emitting diodes to emit light. It is another object of the present invention to provide a high efficiency light which uses different lenses to amplify the intensity of light from LEDs. It is still another object of the present invention to provide a high efficiency light which emit a uniform intensity of light. According to the invention, the high efficiency light comprises a lamp shade, having a hollow conical shape, an inside wall coated with a layer of light reflecting substance, a front open side, and a bottom side; a holder fastened to the bottom side of the lamp shade; a circuit board mounted on the holder inside the lamp shade, the circuit board having a top side coated with a layer of light reflecting substance, a set of light emitting diodes installed in the top side thereof, and a power save control circuit for controlling the operation of the light emitting diodes; a hemispherical inner lens covered on the circuit board over the light emitting diodes inside the lamp shade, the hemispherical inner lens comprising a center convex lens portion at the center, and a plurality of annular convex lens portions around the center convex lens portion thereof; a flat intermediate lens covered on the front open side of the lamp shade, the flat intermediate lens having a center convex lens portion, and a plurality of annular biconvex lens portions around the center convex lens portion thereof; and a hollow rounded outer lens mounted on the front open side of the lamp shade over the flat intermediate lens and sealed by a packing ring, the hollow rounded outer lens comprising a center convex lens portion at the center, a plurality of annular convex lens portions around the center convex lens portion thereof, and a plurality of beehive-like convex lens portions around the annular convex lens portion thereof.

DETAILED DESCRIPTION OF THE PREFERRED EMBODIMENT

Figure 1:
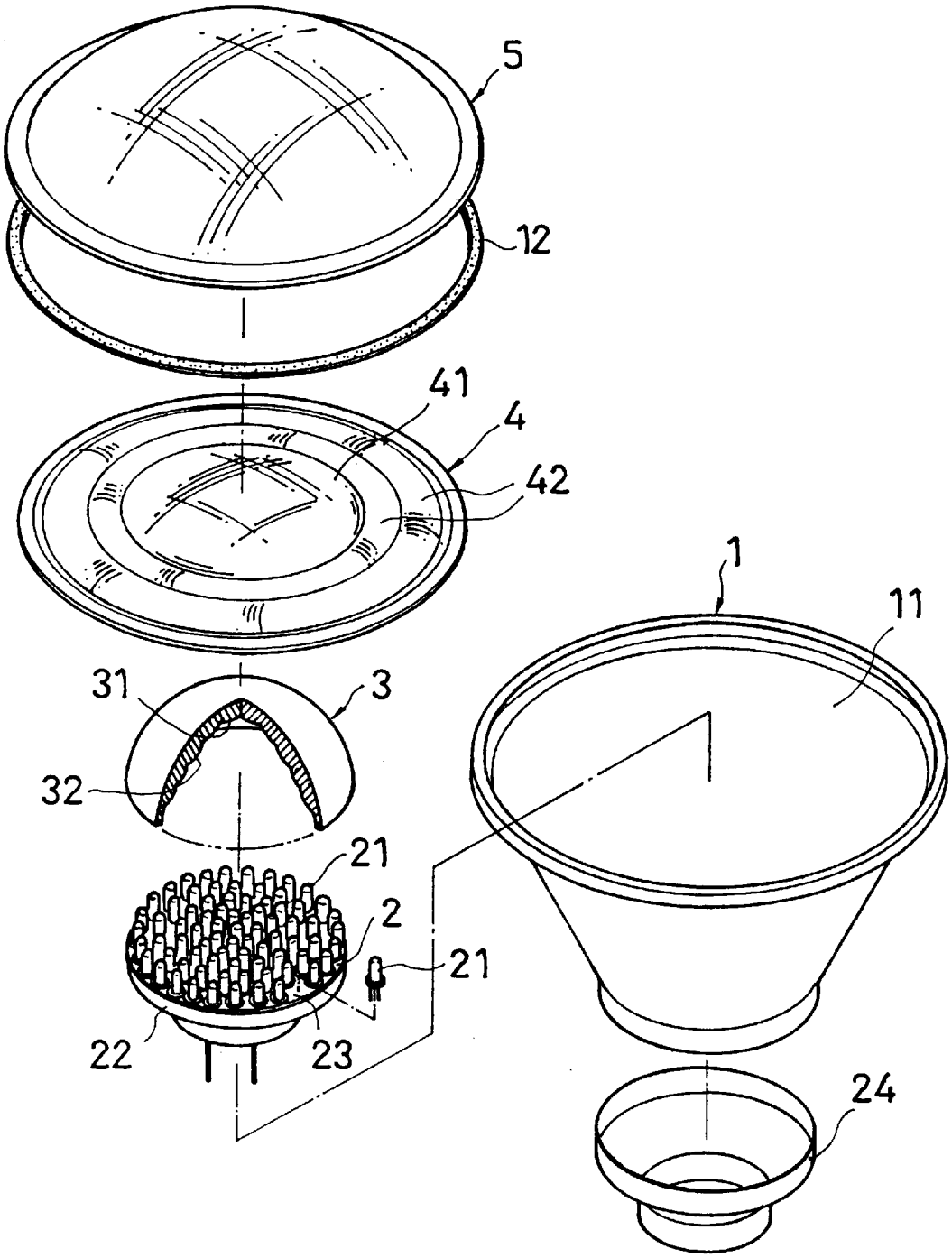
FIG. 1 is an exploded view of a high efficiency light according to the present invention.
Figure 2:
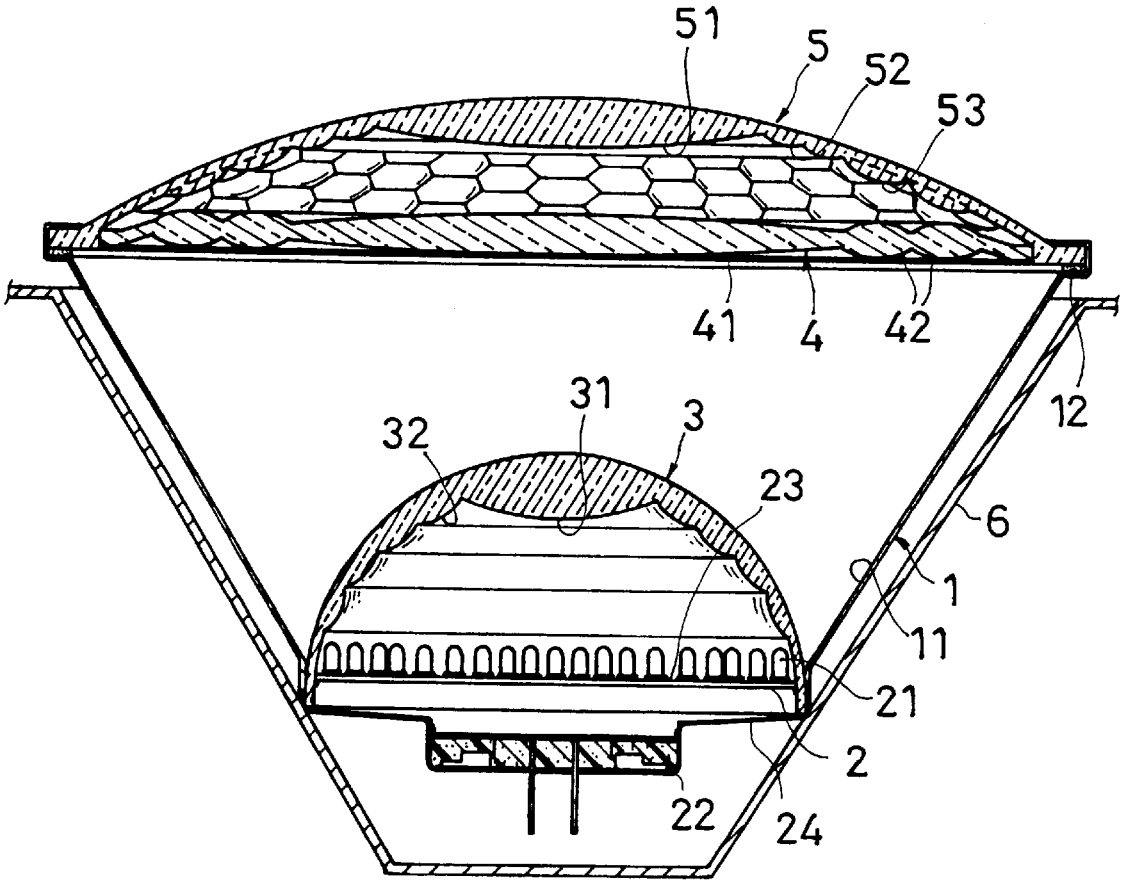
FIG. 2 is a sectional assembly view of the high efficiency light shown in FIG. 1.
Figure 3:
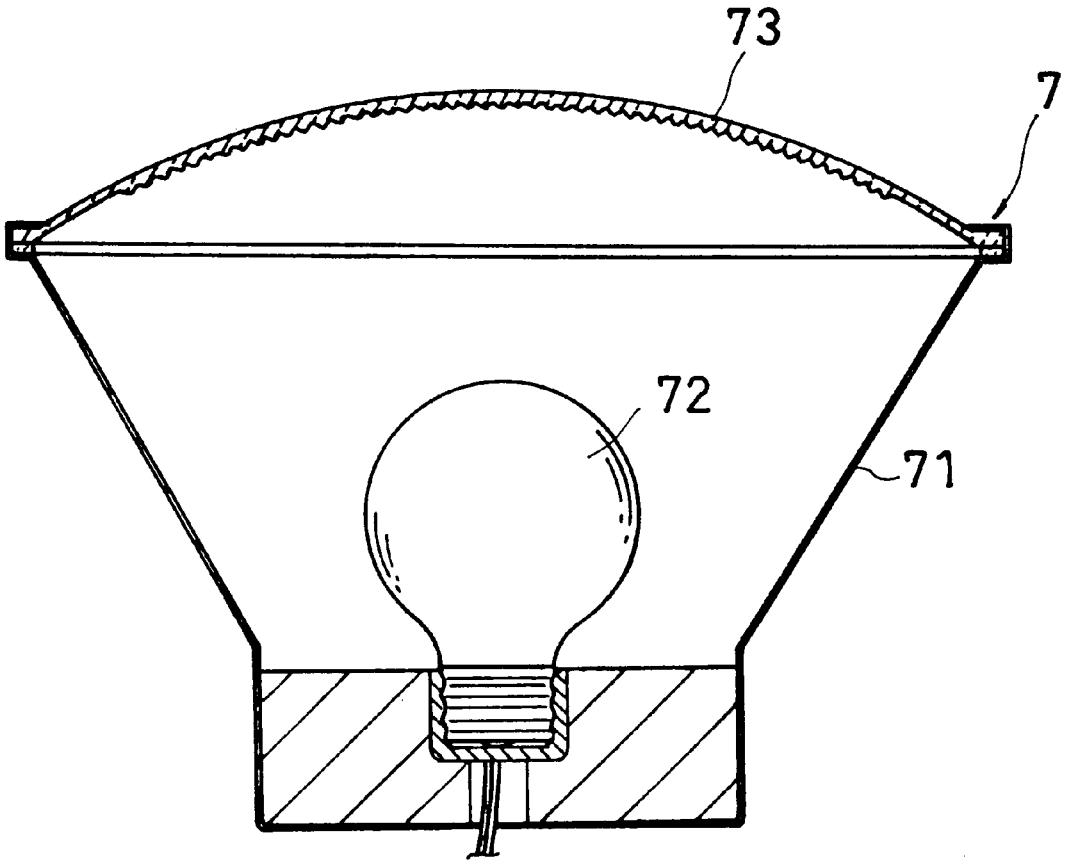
FIG.3 PRIOR ART
FIG. 3 is a sectional view of an incandescent lamp type signal light according to the prior art.
Figure 4:
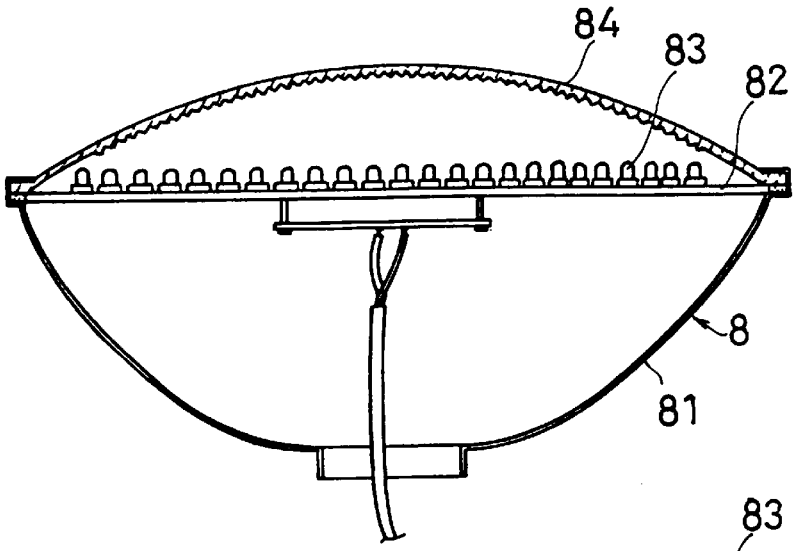
FIG.4 PRIOR ART
FIG. 4 is a sectional view of a LED type signal light according to the prior art.
Figure 5A:
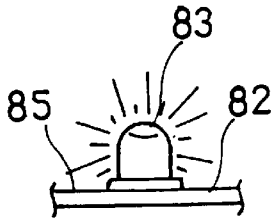
FIG.5A PRIOR ART
FIG. 5A is a partial view of FIG. 4 in an enlarged scale, showing the relationship between the LED and the circuit board.
Figure 5:
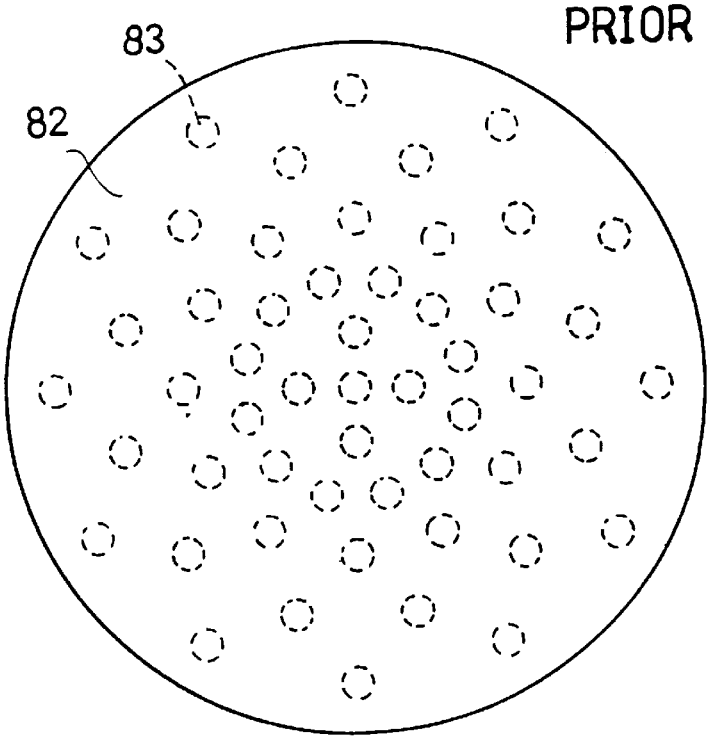
FIG.5 PRIOR ART
FIG. 5 is a front view of the LED type signal light shown in FIG. 4.

Referring to FIGS. 1 and 2, a high efficiency signal light in accordance with the present invention comprises a lamp shade 1 mounted in a signal light bracket 6. The lamp shade 1 is a hollow conical member having a front open side. The inside wall of the lamp shade 1 is a light reflecting surface 11. A holder 24 is fastened to the lamp shade 1 at the bottom. A circuit board 2 is mounted on the holder 24 inside the lamp shade 1. The circuit board 2 holds a set of LEDs (light emitting diodes) 21. A power save control circuit 22 is mounted in the circuit board 2 at the bottom. A hemispherical inner lens 3 is covered on the circuit board 2 over the LEDs 21. The hemispherical inner lens 3 comprises a center convex lens portion 31 at the center which amplifies light from center area of the LEDs 21 and diffuses it in different directions, and a plurality of annular convex lens portions 32 around the center convex lens portion 31 which amplify light from border area of the LEDs 21 and diffuse it in different directions. Light passing through the hemispherical inner lens 3 is then reflected outwards by the reflecting surface 11 of the lamp shade 1. A flat intermediate lens 4 is covered on the front open side of the lamp shade 1. A hollow rounded outer lens 5 is mounted on the front open side of the lamp shade 1 over the flat intermediate lens 4, and sealed by a packing ring 12. The flat intermediate lens 4 has a center convex lens portion 41, and a plurality of annular biconvex lens portions 42 around the center convex lens portion 41. The center convex lens portion 41 and the annular biconvex lens portions 42 amplify the intensity of light passing through. The hollow rounded outer lens 5 comprises a center convex lens portion 51 at the center which amplifies light passing through the center convex lens portion 41 of the flat intermediate lens 4, a plurality of annular convex lens portions 52 around the center convex lens portion 51 and a plurality of beehive-like convex lens portions 53 around the annular convex lens portion 52. The annular convex lens portions 52 and the beehive-like convex lens portions 53 amplify light passing through the border area of the intermediate lens 4.

Further, the top side 23 of the circuit board 2 in which the LEDs 21 are installed is coated with a layer of light reflecting substance.

When the LEDs 21 are turned on, the intensity of light from the LEDs 21 is amplified by the hemispherical inner lens 3, the flat intermediate lens 4 and the hollow rounded outer lens 5.

While only one embodiment of the present invention has been shown and described, it will be understood that various modifications and changes could be made thereunto without departing from the spirit and scope of the invention disclosed.

What the invention claimed is:

1. A high efficiency light comprising:

a lamp shade, having a hollow conical shape, an inside wall coated with a layer of light reflecting substance, a front open side, and a bottom side;

a holder fastened to the bottom side of said lamp shade;

a circuit board mounted on said holder inside said lamp shade, said circuit board having a top side coated with a layer of light reflecting substance, a set of light emitting diodes installed in the top side thereof, and a power save control circuit for controlling the operation of said light emitting diodes;

a hemispherical inner lens mounted on said circuit board over said light emitting diodes inside said lamp shade, said hemispherical inner lens comprising a center convex lens portion at the center, and a plurality of annular convex lens portions around the center convex lens portion thereof;

a flat intermediate lens mounted on the front open side of said lamp shade, said flat intermediate lens having a center convex lens portion, and a plurality of annular biconvex lens portions around the center convex lens portion thereof; and a hollow rounded outer lens mounted on the front open side of said lamp shade over said flat intermediate lens and sealed by a packing ring, said hollow rounded outer lens comprising a center convex lens portion at the center, a plurality of annular convex lens portions around the center convex lens portion thereof, and a plurality of beehive-like convex lens portions around the annular convex lens portion thereof.

2. The high efficiency light of claim 1 which is installed in a signal light bracket and used as a signal light.

* * * * *